US009459559B1

(12) United States Patent
Sakamoto et al.

(10) Patent No.: US 9,459,559 B1
(45) Date of Patent: Oct. 4, 2016

(54) DEVELOPING DEVICE AND IMAGE FORMING APPARATUS

(71) Applicant: FUJI XEROX CO., LTD., Tokyo (JP)

(72) Inventors: Takashi Sakamoto, Kanagawa (JP); Takashi Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/887,759

(22) Filed: Oct. 20, 2015

(30) Foreign Application Priority Data

Jun. 17, 2015 (JP) ..... 2015-122179

(51) Int. Cl.
*G03G 15/08* (2006.01)

(52) U.S. Cl.
CPC ..... *G03G 15/0891* (2013.01); *G03G 15/0887* (2013.01); *G03G 2215/0822* (2013.01); *G03G 2215/0838* (2013.01)

(58) Field of Classification Search
CPC ..... G03G 15/0822; G03G 15/0887; G03G 15/0889; G03G 15/0891; G03G 15/0893; G03G 2215/0802; G03G 2215/0819; G03G 2215/0822; G03G 2215/0838
USPC ..... 399/254, 256
See application file for complete search history.

(56) References Cited

U.S. PATENT DOCUMENTS 8,045,893 B2 * 10/2011 Nakayama ..... G03G 15/0808 399/254
2004/0076452 A1 * 4/2004 Nishitani ..... G03G 15/0822 399/254
2006/0029432 A1 * 2/2006 Arimoto ..... G03G 15/09 399/254
2007/0274742 A1 * 11/2007 Nakayama ..... G03G 15/0893 399/254
2009/0245878 A1 * 10/2009 Aoki ..... G03G 15/0893 399/254
2012/0039627 A1 * 2/2012 Kubo ..... G03G 15/0844 399/256 X
2012/0219327 A1 * 8/2012 Mihara ..... G03G 15/0893 399/254

FOREIGN PATENT DOCUMENTS

JP 2007-304450 A 11/2007
JP 2009-058597 A 3/2009

* cited by examiner

*Primary Examiner* — Sophia S Chen
(74) *Attorney, Agent, or Firm* — Oliff PLC

(57) ABSTRACT

A developing device includes a developing member that delivers a developer to an image carrier while rotating, a transport-supply member that extends in one direction and that supplies the developer, which contains a toner, to the developing member while transporting the developer from a first side to a second side in the one direction, and a transport-stirring member that is disposed along a transport-stirring path, which is inclined in an upward direction with respect to a horizontal direction, the transport-stirring member being configured to receive the developer, which is transported by the transport-supply member, from a portion of the transport-supply member on the second side in the one direction, stir the received developer while transporting the developer upward along the transport-stirring path, and deliver the developer to a portion of the transport-supply member on the first side in the one direction.

4 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-122179 filed Jun. 17, 2015.

BACKGROUND

Technical Field

The present invention relates to a developing device and an image forming apparatus.

SUMMARY

According to an aspect of the invention, there is provided a developing device including a developing member that delivers a developer to an image carrier while rotating, a transport-supply member that extends in one direction and that supplies the developer, which contains a toner, to the developing member while transporting the developer from a first side to a second side in the one direction, and a transport-stirring member that is disposed along a transport-stirring path, which is inclined in an upward direction with respect to a horizontal direction, the transport-stirring member being configured to receive the developer, which is transported by the transport-supply member, from a portion of the transport-supply member on the second side in the one direction, stir the received developer while transporting the developer upward along the transport-stirring path, and deliver the developer to a portion of the transport-supply member on the first side in the one direction.

BRIEF DESCRIPTION OF THE DRAWINGS

Exemplary embodiments of the present invention will be described in detail based on the following figures, wherein.

DETAILED DESCRIPTION

First Exemplary Embodiment

An example of a developing device according to a first exemplary embodiment of the present invention and an example of an image forming apparatus according to the first exemplary embodiment of the present invention will be described with reference to FIG. 1A to FIG. 6. Note that, in each of the drawings, arrow H, arrow W, and arrow D respectively indicate a top-bottom direction of the developing device and the image forming apparatus (vertical direction), a width direction of the developing device and the image forming apparatus (horizontal direction), and a depth direction of the developing device and the image forming apparatus (horizontal direction).

(Overall Configuration)

Figure 6:
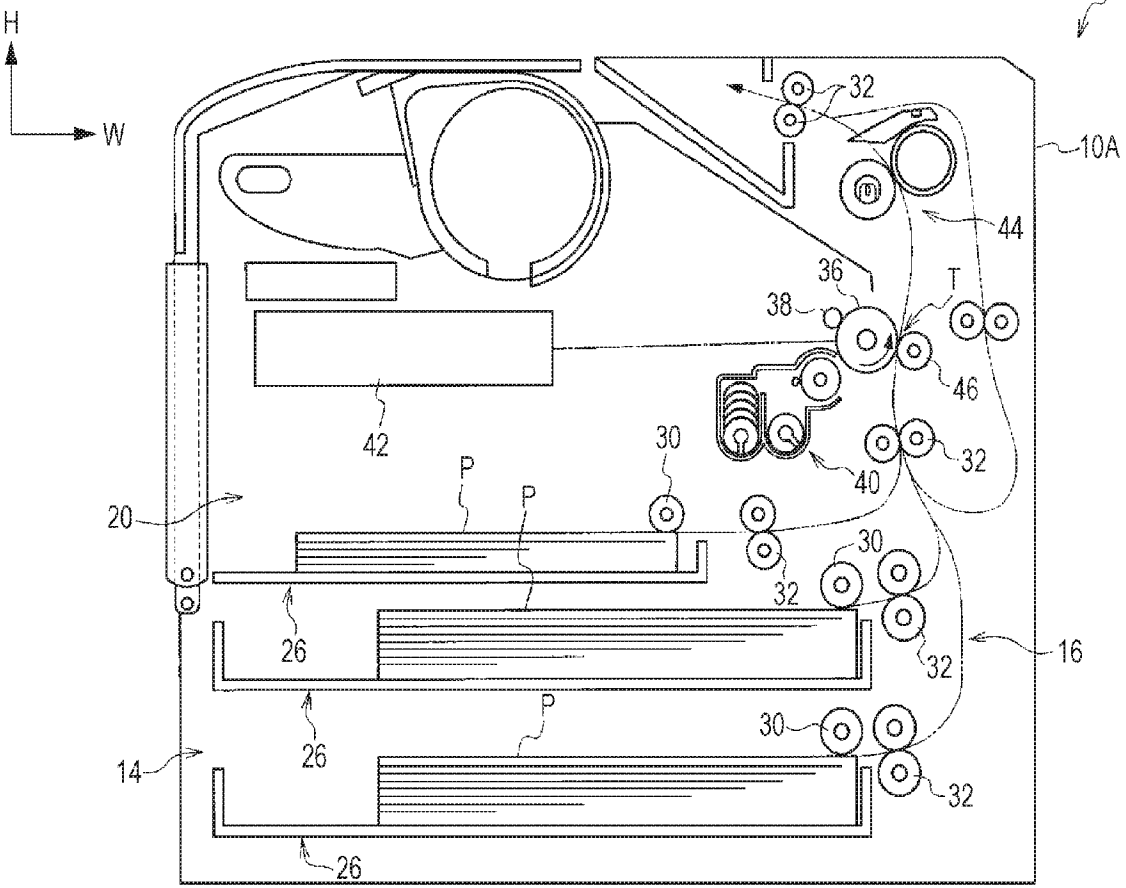
FIG. 6 is a schematic diagram illustrating an image forming apparatus according to the first exemplary embodiment of the present invention.

As illustrated in FIG. 6, in an image forming apparatus 10 according to the first exemplary embodiment, an accommodating unit 14, a transport unit 16, and an image forming unit 20 are disposed in this order from the lower side to the upper side in the top-bottom direction (direction of arrow H). Sheet members P, each of which serves as a recording medium, are accommodated in the accommodating unit 14. The transport unit 16 transports the sheet members P, which are accommodated in the accommodating unit 14. The image forming unit 20 performs image formation on the sheet members P, which are to be transported from the accommodating unit 14 by the transport unit 16, one at a time.

[Accommodating Unit]

The accommodating unit 14 includes three accommodating members 26 each of which is capable of being drawn out in the depth direction of the image forming apparatus 10 from an apparatus body 10A of the image forming apparatus 10, and the sheet members P are stacked in the accommodating members 26. Each of the accommodating members 26 is provided with a delivery roller 30 that sends out the sheet members P, which are stacked in the corresponding accommodating member 26, one at a time to the transport unit 16.

[Transport Unit]

The transport unit 16 includes plural transport rollers 32 each of which transports the sheet members P one at a time.

[Image Forming Unit]

The image forming unit 20 includes an image carrier 36 and a charging roller 38, which is an example of a charging device that charges a surface of the image carrier 36. The image forming unit 20 further includes an exposure device 42 and a developing device 40. The exposure device 42 exposes the charged surface of the image carrier 36 to exposure light on the basis of image data so as to form an electrostatic latent image. The developing device 40 develops the electrostatic latent image so as to visualize the electrostatic latent image as a toner image.

The image forming unit 20 includes a transfer roller 46 and a fixing device 44. The transfer roller 46 transfers a toner image, which has been formed on the surface of the image carrier 36, onto one of the sheet members P, which is transported along the transport unit 16, and the fixing device 44 fixes the toner image, which has been transferred to the sheet member P, onto the sheet member P by applying heat and pressure to the toner image.

Note that the developing device 40 will be described in detail later.

(Effects of Overall Configuration)

In the image forming apparatus 10, an image is formed in the following manner.

First, the charging roller 38, to which a voltage has been applied, uniformly and negatively charges the surface of the image carrier 36 to a predetermined potential by being brought into contact with the surface of the image carrier 36. Next, the exposure device 42 radiates the exposure light onto the charged surface of the image carrier 36 on the basis of image data input from the outside and forms an electrostatic latent image.

As a result, an electrostatic latent image corresponding to the image data is formed on the surface of the image carrier 36. Subsequently, the developing device 40 develops the electrostatic latent image so as to visualize the electrostatic latent image as a toner image.

Then, one of the sheet members P, which has been sent from one of the accommodating members 26 to the transport unit 16 by the corresponding delivery roller 30, is sent to a transfer position T at which the image carrier 36 and the transfer roller 46 are in contact with each other. At the transfer position T, the sheet member P is transported by the image carrier 36 and the transfer roller 46 while being sandwiched therebetween, so that the toner image, which has been formed on the surface of the image carrier 36, is transferred onto the sheet member P.

After that, the fixing device 44 fixes the toner image, which has been transferred to the sheet member P, onto the sheet member P. Finally, the sheet member P, to which the toner image has been fixed, is ejected to outside the apparatus body 10A by the transport rollers 32.

(Configuration of Principal Portion)

The developing device 40 will now be described.

Figure 5:
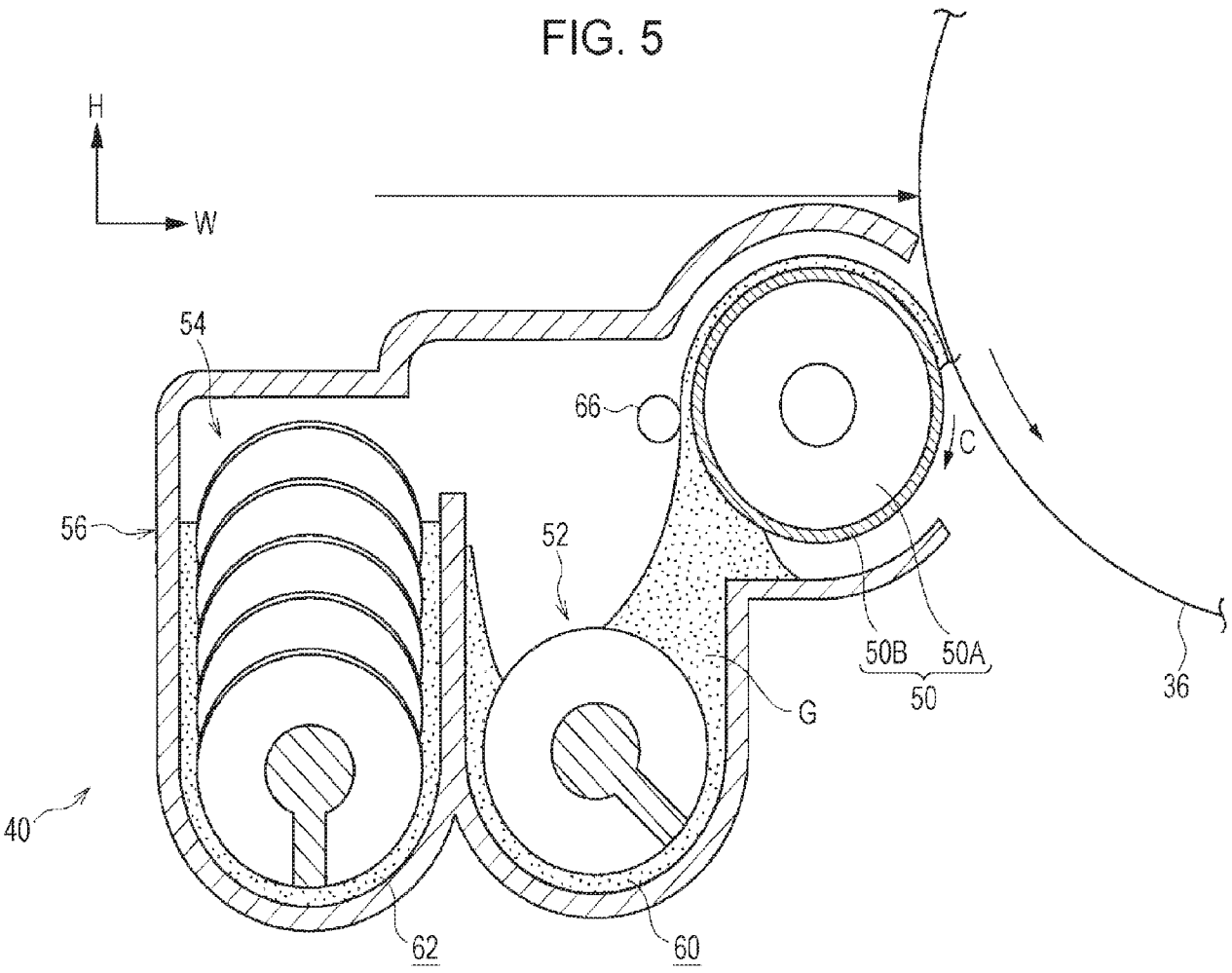
FIG. 5 is a cross-sectional view illustrating the developing device according to the first exemplary embodiment of the present invention.

As illustrated in FIG. 5, the developing device 40 includes a developing roller 50 and a layer-thickness controlling roller 66. The developing roller 50 is disposed in such a manner as to face the image carrier 36, and the layer-thickness controlling roller 66 controls the layer thickness of a developer G on the developing roller 50. The developing device 40 further includes a supply auger 52, which is an example of a transport-supply member that supplies the developer G to the developing roller 50, a stirring auger 54, which is an example of a transport-stirring member that stirs the developer G, and a housing 56 in which the above-mentioned members of the developing device 40 are accommodated.

Note that the developer G is a two-component developer that contains a toner and magnetic carrier particles.

[Developing Roller and Layer-Thickness Controlling Roller]

The developing roller 50 has a rotary shaft extending in the depth direction of the developing device 40 (hereinafter referred to as device-depth direction) and is arranged in such a manner that a gap (development gap) is formed between the developing roller 50 and the image carrier 36 as illustrated in FIG. 5.

The developing roller 50 includes a magnet roller 50A having a circular cross section and a rotary sleeve 50B. The rotary sleeve 50B covers the magnet roller 50A and rotates around the magnet roller 50A. The rotary sleeve 50B receives a force that causes the rotary sleeve 50B to rotate from a driving source (not illustrated) and rotates in the direction of arrow C in FIG. 5 (clockwise direction).

The layer-thickness controlling roller 66 is disposed so as to oppose the image carrier 36 across the developing roller 50. A gap is formed between the layer-thickness controlling roller 66 and the developing roller 50 in order to control the layer thickness of the developer G on the developing roller 50.

[Supply Auger and Transport-Supply Path]

Figure 4:
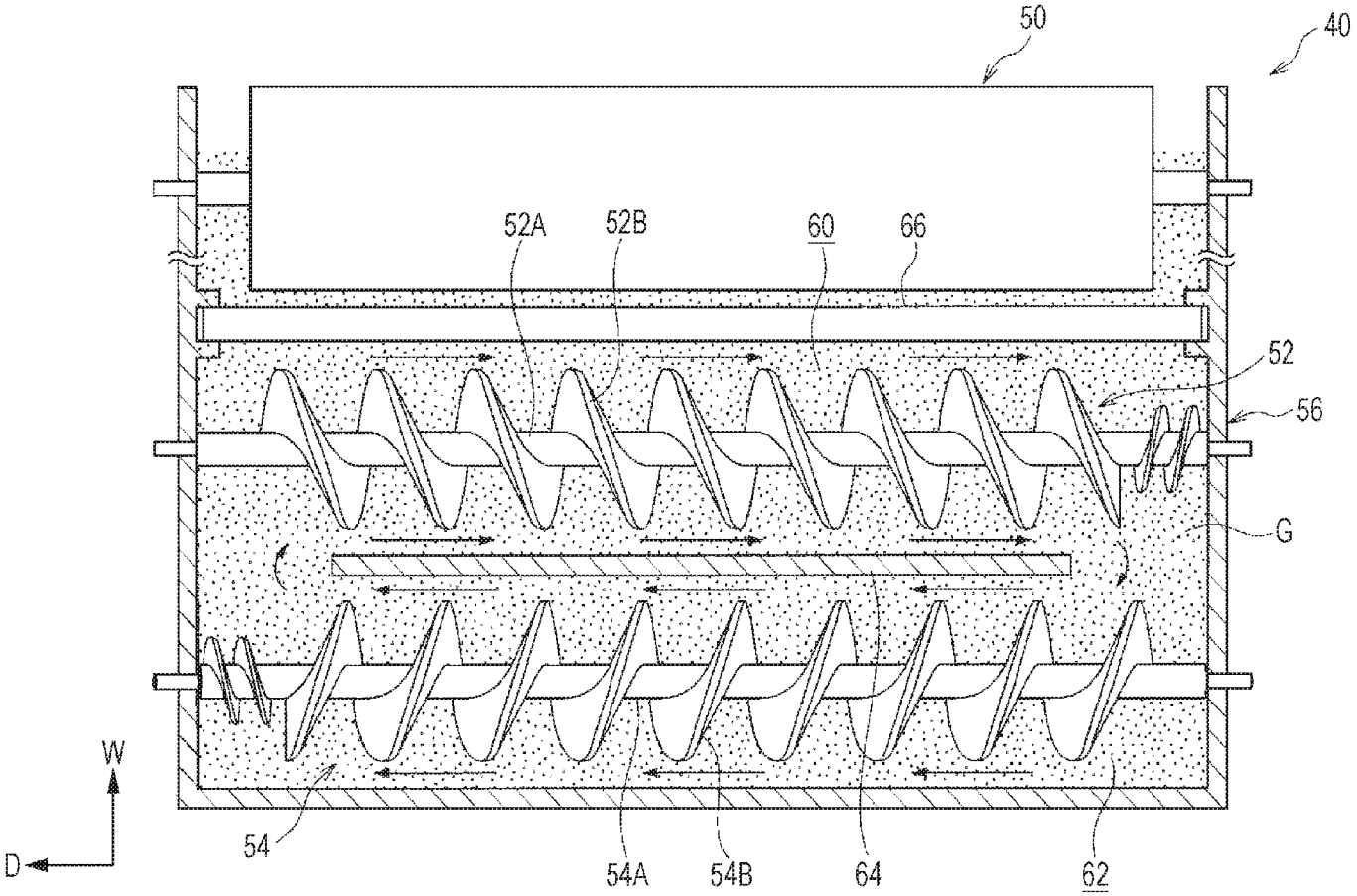
FIG. 4 is a sectional view illustrating the developing device according to the first exemplary embodiment of the present invention.

When viewed from the device-depth direction, the supply auger 52 is positioned diagonally below the developing roller 50 and is disposed in a transport-supply path 60. The transport-supply path 60 extends in the device-depth direction, which is an example of one direction, and is U-shaped when viewed in cross section. As illustrated in FIG. 4, the supply auger 52 includes a rotary shaft 52A that extends in the device-depth direction and a helical blade 52B that extends in a helical manner and that is formed on the outer peripheral surface of the rotary shaft 52A. The rotary shaft 52A is rotatably supported by a wall portion of the housing 56, and a gear (not illustrated) that receives a rotational force from the driving source is fixed to an end of the rotary shaft 52A.

With this configuration, the supply auger 52, which rotates, transports the developer G from a far side (left side in FIG. 4) to a near side (right side in FIG. 4) in the device-depth direction (i.e., from a first side to a second side in one direction) while stirring the developer G in the transport-supply path 60 and supplies the developer G to the developing roller 50.

[Stirring Auger and Transport-Stirring Path]

When viewed from the top direction, the stirring auger 54 is disposed so as to oppose the developing roller 50 across the supply auger 52.

Figure 2:
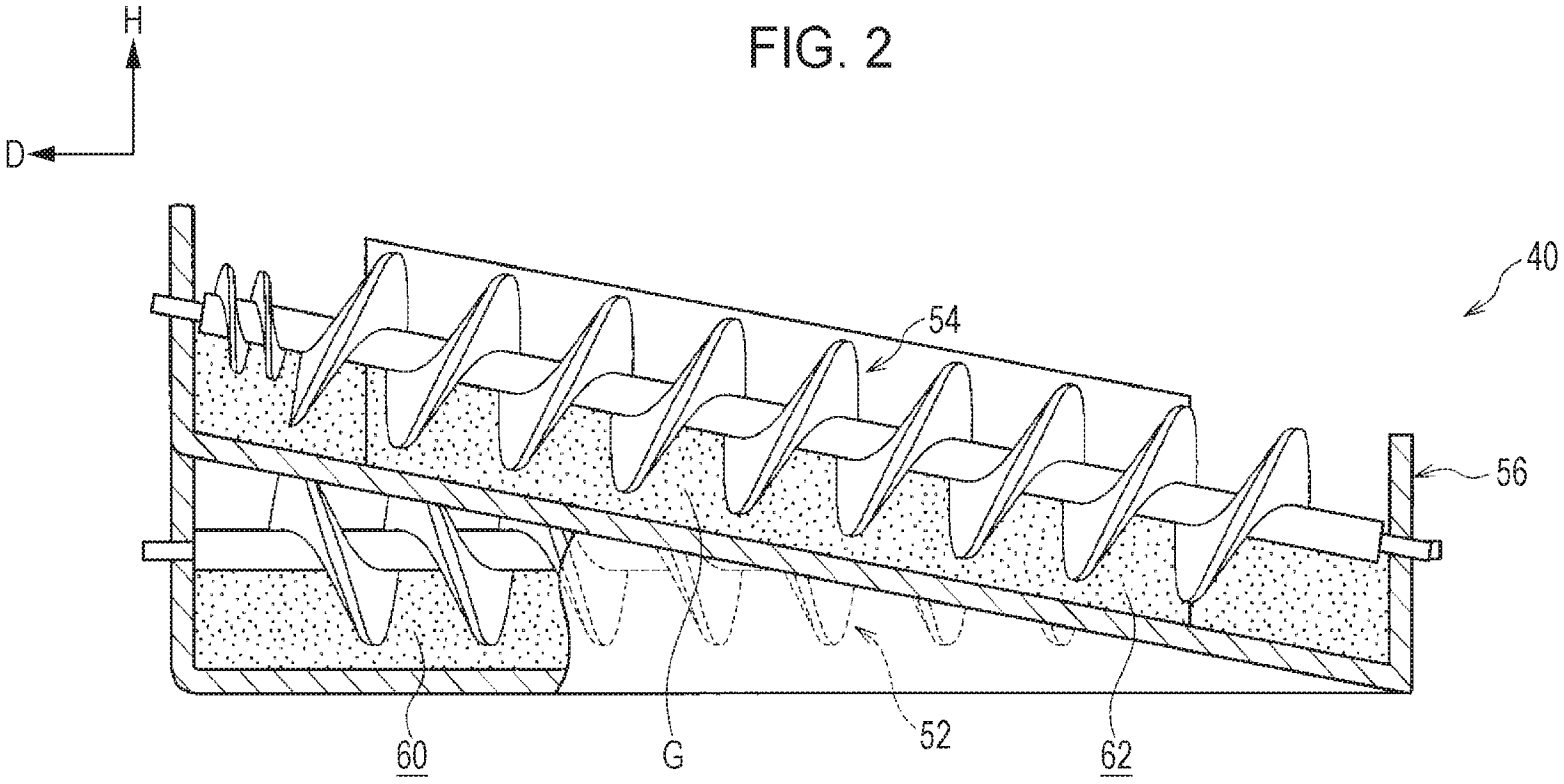
FIG. 2 is a front view illustrating the stirring auger, the transport-stirring path, a supply auger, and a transport-supply path that are included in the developing device according to the first exemplary embodiment of the present invention.
Figure 3:
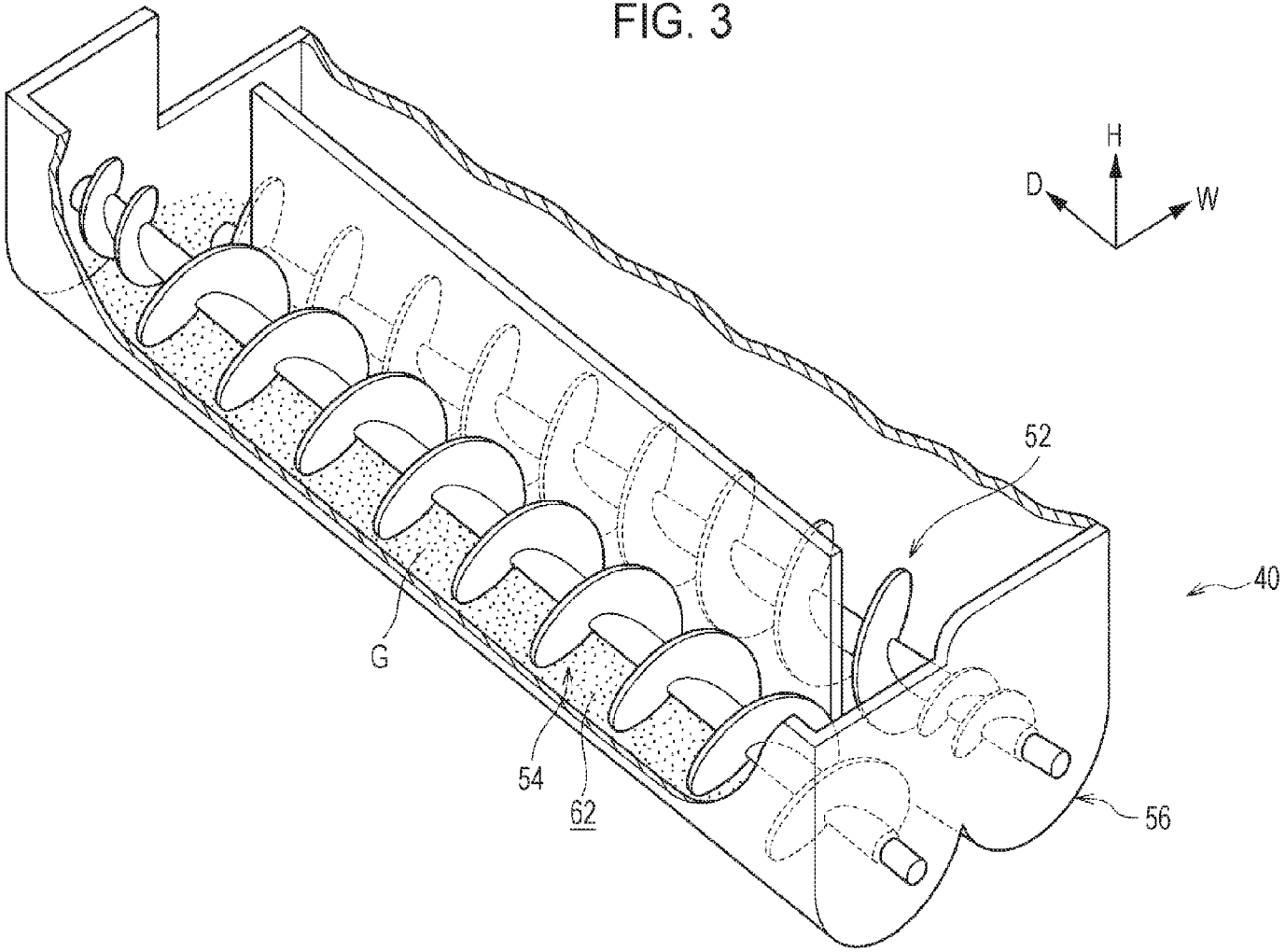
FIG. 3 is a sectional view illustrating the stirring auger, the transport-stirring path, the supply auger, and the transport-supply path of the developing device according to the first exemplary embodiment of the present invention.

As illustrated in FIG. 2 and FIG. 3, the stirring auger 54 is disposed along a transport-stirring path 62 that extends in a direction that is inclined with respect to the device-depth direction (horizontal direction) and that is U-shaped when viewed in cross section. As illustrated in FIG. 4, a partition wall 64 is formed between the transport-stirring path 62 and the transport-supply path 60. The partition wall 64 isolates the transport-stirring path 62 and the transport-supply path 60 from each other with the exception of portions of the transport-stirring path 62 and the transport-supply path 60 on the far side in the device-depth direction and portions of the transport-stirring path 62 and the transport-supply path 60 on the near side in the device-depth direction.

More specifically, the portion of the transport-stirring path 62 on the near side in the device-depth direction (right side in FIG. 2 and FIG. 3) and the portion of the transport-supply path 60 on the near side in the device-depth direction are positioned at a similar level in the top-bottom direction. In other words, when viewed from the width direction of the developing device 40, the portion of the transport-stirring path 62 on the near side in the device-depth direction is superposed with the portion of the transport-supply path 60 on the near side in the device-depth direction.

In addition, in the top-bottom direction, the portion of the transport-stirring path 62 on the far side in the device-depth direction (left side in FIG. 2 and FIG. 3) is positioned at a level higher than that at which the portion of the transport-supply path 60 on the far side in the device-depth direction is positioned. Consequently, the transport-stirring path 62 and the stirring auger 54 extend in the direction that is inclined with respect to the device-depth direction (horizontal direction).

As illustrated in FIG. 4, the stirring auger 54 includes a rotary shaft 54A and a helical blade 54B that extends in a helical manner and that is formed on the outer peripheral surface of the rotary shaft 54A. The rotary shaft 54A is rotatably supported by the wall portion of the housing 56, and a gear (not illustrated) that receives a rotational force from the driving source is fixed to an end of the rotary shaft 54A.

With this configuration, as illustrated in FIG. 4, a portion of the stirring auger 54, which rotates, on the near side in the device-depth direction receives the developer G, which is transported by the supply auger 52, from the supply auger 52. Then, as illustrated in FIG. 2, the stirring auger 54, which rotates, transports the developer G upward from the near side in the device-depth direction (right side in FIG. 2) to the far side in the device-depth direction (left side in FIG. 2) along the transport-stirring path 62 while stirring the developer G. In addition, a portion of the stirring auger 54, which rotates, on the far side in the device-depth direction delivers the developer G to the supply auger 52.

(Effects of Configuration of Principal Portion)

Effects of the developing device 40 will now be described.

In the housing 56 of the developing device 40, as illustrated in FIG. 4, the supply auger 52, which rotates, and the stirring auger 54, which rotates, stir the developer G by transporting the developer G in the direction of arrows illustrated in FIG. 4 in such a manner that the developer G circulates. As a result of the developer G being stirred, the toner and the carrier are rubbed against each other, and the toner is triboelectrically-charged to a predetermined potential.

Then, as illustrated in FIG. 5, the supply auger 52, which rotates, supplies the developer G to the developing roller 50. The developer G, which has been supplied to the developing roller 50, is held on a surface of the developing roller 50 in a state of forming a magnetic brush (not illustrated) by the magnetic force of the magnet roller 50A.

The rotary sleeve 50B, which rotates, transports the developer G, and the layer-thickness controlling roller 66 controls the layer thickness of the developer G held on the developing roller 50 (rotary sleeve 50B).

In addition, the rotary sleeve 50B, which rotates, transports the developer G, whose layer thickness has been controlled by the layer-thickness controlling roller 66, to a position facing the image carrier 36. Then, only the toner, which is included in the developer G that has been transported to the position facing the image carrier 36, is deposited onto the electrostatic latent image, which has been formed on the image carrier 36, and as a result, the electrostatic latent image is visualized as a toner image. More specifically, the toner, which has been charged to a predetermined potential, is deposited onto the electrostatic latent image, which has been formed on the image carrier 36, by an electrostatic force, and as a result, the electrostatic latent image is visualized as a toner image.

Figure 1A:
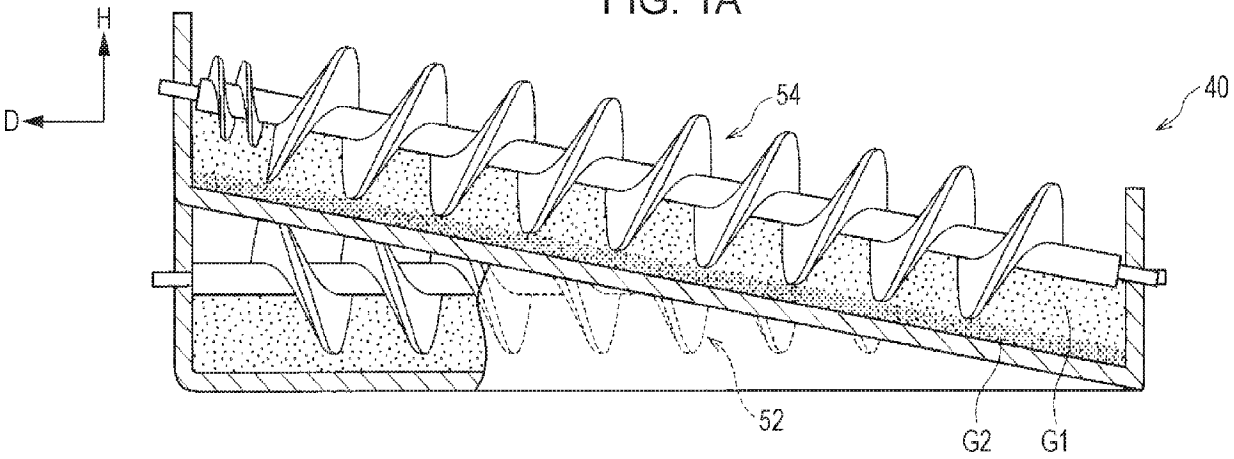
FIGS. 1A and 1B are sectional views each illustrating a stirring auger and a transport-stirring path that are included in a developing device according to a first exemplary embodiment of the present invention.
Figure 1B:
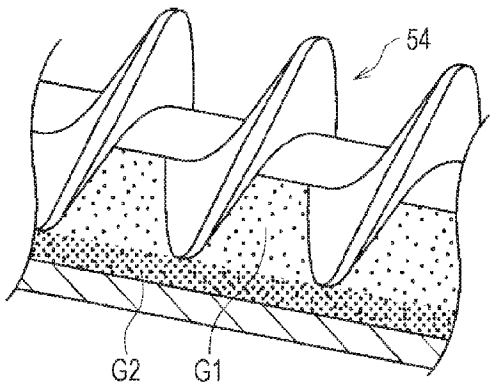

Here, as illustrated in FIG. 2, the stirring auger 54, which stirs the developer G, and the transport-stirring path 62, in which the stirring auger 54 is disposed, are inclined with respect to the device-depth direction (horizontal direction). Thus, as illustrated in FIGS. 1A and 1B, part of the developer G (hereinafter referred to as a developer G1 for convenience of description) that is transported by the stirring auger 54 and part of the developer G (hereinafter referred to as a developer G2 for convenience of description) that is present between the stirring auger 54 and a wall surface of the transport-stirring path 62 are present in the transport-stirring path 62.

The stirring auger 54, which rotates, applies to the developer G1 a force that forcibly causes the developer G1 to be transported upward along the transport-stirring path 62. On the other hand, this force that is applied by the stirring auger 54, which rotates, does not directly act on the developer G2, and thus, a force that causes the developer G2 to be transported downward along the transport-stirring path 62 acts on the developer G2 due to gravity.

Thus, the developer G1 and the developer G2 rub against each other at an interface between the developer G1 and the developer G2. Note that, in the case where the stirring auger 54 is arranged so as to extend in the horizontal direction, the force that causes the developer G2 to be transported downward will not act on the developer G2 due to gravity, and thus, the developer G1 and the developer G2 will not rub against each other.

Second Exemplary Embodiment

An example of a developing device according to a second exemplary embodiment of the present invention and an example of an image forming apparatus according to the second exemplary embodiment of the present invention will now be described with reference to FIG. 7 and FIG. 8. Note that members and the like that are the same as those of the first exemplary embodiment are denoted by the same reference numerals, and descriptions thereof will be omitted. Portions that are different from those of the first exemplary embodiment will be described.

Figure 7:
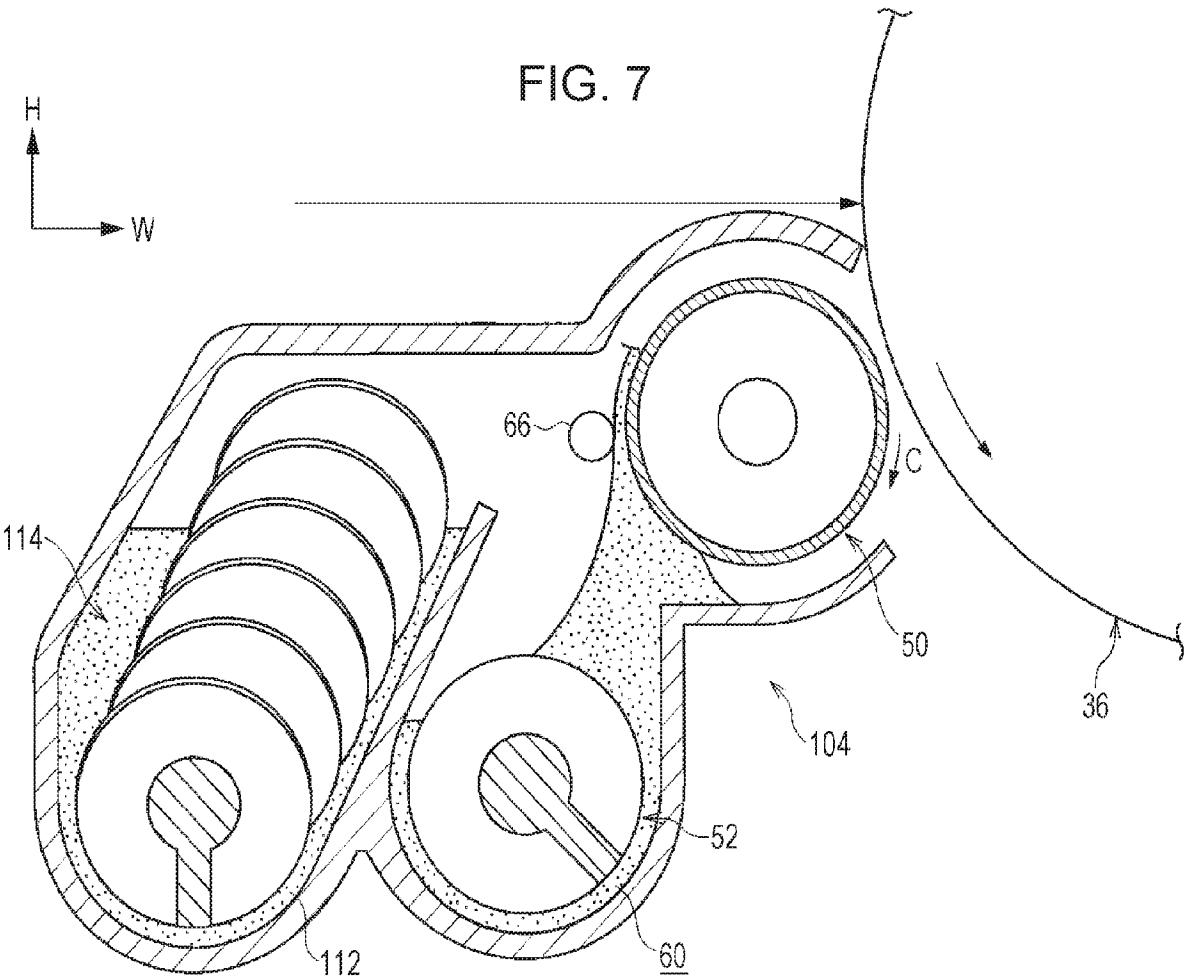
FIG. 7 is a cross-sectional view illustrating a developing device according to a second exemplary embodiment of the present invention.
Figure 8:
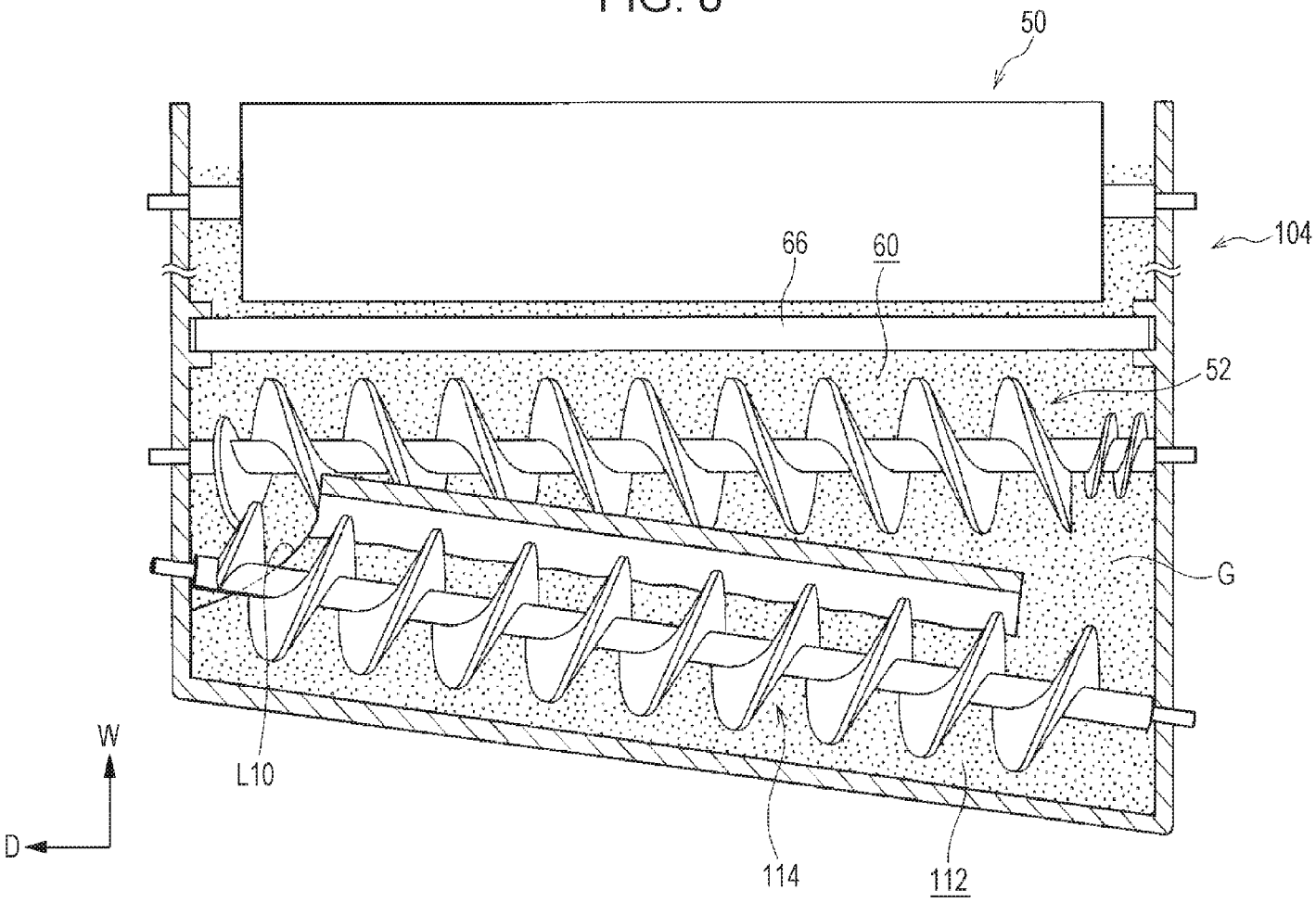
FIG. 8 is a sectional view illustrating the developing device according to the second exemplary embodiment of the present invention.

As illustrated in FIG. 7 and FIG. 8, when viewed from above, a stirring auger 114 and a transport-stirring path 112 that are included in a developing device 104 according to the second exemplary embodiment are inclined with respect to a depth direction of the developing device 104 (hereinafter referred to as device-depth direction). In addition, when viewed from above, a portion of the stirring auger 114 on a far side in the device-depth direction, which is one side in one direction, is superposed with a portion of the supply auger 52 on the far side in the device-depth direction, which is the one side in the one direction.

A portion of a bottom portion of the transport-stirring path 112 on the far side in the device-depth direction is cut away in such a manner that the developer G, which has been transported by the stirring auger 114, falls due to gravity and is delivered to the supply auger 52. Note that a notch line of the portion of the transport-stirring path 112 on the far side in the device-depth direction is indicated by a line L10 illustrated in FIG. 9.

The rest of the effects are similar to those of the first exemplary embodiment.

Note that although the specific exemplary embodiments of the present invention have been described in detail, the present invention is not limited to the exemplary embodiments, and it is obvious to those skilled in the art that the present invention may employ other various exemplary embodiments within the scope of the present invention. For example, in the above-described first and second exemplary embodiments, the portion of the transport-stirring path 62 and the portion of the transport-stirring path 112 on the near side in the device-depth direction are each positioned at a level similar to that at which the transport-supply path 60 is positioned. However, the portion of the transport-stirring path 62 and the portion of the transport-stirring path 112 on the near side in the device-depth direction may be positioned at a level lower than that at which the transport-supply path 60 is positioned as long as the transport-stirring path 62 and the transport-stirring path 112 are inclined with respect to the horizontal direction and transport the developer G upward.

In addition, although the two-component developer has been described as an example in the above-described exemplary embodiments, a mono-component developer may be used.

Furthermore, although not particularly described in the above-described second exemplary embodiment, at least part of the developer G, which is transported by the stirring auger 114, may drop due to gravity and be delivered to the supply auger 52.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing member that delivers a developer to an image carrier while rotating;

a transport-supply member that extends in one direction and that supplies the developer, which contains a toner, to the developing member while transporting the developer from a first side to a second side in the one direction;

a transport-stirring member that is disposed along a transport-stirring path, which is inclined in an upward direction with respect to a horizontal direction, the transport-stirring member being configured to receive the developer, which is transported by the transport-supply member, from a portion of the transport-supply member on the second side in the one direction, stir the received developer while transporting the developer upward along the transport-stirring path, and deliver the developer to a portion of the transport-supply member on the first side in the one direction;

a transport-supply path in which the transport-supply member is disposed; and a transport-stirring path in which the transport-stirring member is disposed, wherein the transport-supply member is disposed below the developing member and transports the developer along the transport-supply path, and wherein a lowest portion of the transport-stirring path on the second side and a lowest portion of the transport-supply path on the second side are located at a substantially similar level in a top-bottom direction of the developing device.

2. The developing device according to claim 1, wherein a portion of the transport-stirring member on the first side in the one direction is superposed with the portion of the transport-supply member on the first side in the one direction when viewed from above, and wherein at least part of the developer, which is to be delivered to the transport-supply member by the portion of the transport-stirring member on the first side in the one direction, is delivered as a result of being dropped from the transport-stirring path.

3. An image forming apparatus comprising:

an image carrier on which an electrostatic latent image is to be formed;

the developing device according to claim 2 that develops the electrostatic latent image formed on the image carrier into a toner image; and a transfer device that transfers the toner image formed on the image carrier onto a recording medium.

4. An image forming apparatus comprising:

an image carrier on which an electrostatic latent image is to be formed;

the developing device according to claim 1 that develops the electrostatic latent image formed on the image carrier into a toner image; and a transfer device that transfers the toner image formed on the image carrier onto a recording medium.

* * * * *